United States Patent [19]

Hallez

[11] Patent Number: 4,765,097

[45] Date of Patent: Aug. 23, 1988

[54] SURFACE-DRESSING ROLLERTOOL

[75] Inventor: Charles P. Hallez, Tellin, Belgium

[73] Assignee: Diamant Boart Societe Anonyme, Brussels, Belgium

[21] Appl. No.: 74,194

[22] Filed: Jul. 16, 1987

Related U.S. Application Data

[63] Continuation of Ser. No. 877,814, Jun. 24, 1986, abandoned.

[30] Foreign Application Priority Data

Jun. 24, 1985 [BE] Belgium ..... 0/215250

[51] Int. Cl.[4] ..... B24B 7/22

[52] U.S. Cl. ..... 51/90; 51/177; 51/283 R

[58] Field of Search ..... 51/72 R, 90, 176, 177, 51/281 R, 283 R, 206 P, 330; 15/93 R, 236 R; 125/5; 407/7; 299/41

[56] References Cited

U.S. PATENT DOCUMENTS

| | | | |
|---|---|---|---|
| 1,663,759 | 3/1928 | Ham | 51/177 |
| 1,860,794 | 5/1932 | Yerk et al. | 51/90 |
| 2,420,876 | 5/1947 | Freud | 51/90 |
| 2,450,157 | 9/1948 | Peckett | 51/281 R X |
| 2,688,826 | 9/1954 | Peckett | 51/90 |
| 4,185,350 | 1/1980 | Fish | 15/236 R |
| 4,188,755 | 2/1980 | Fitzpatrick | 51/206 P |
| 4,361,987 | 12/1982 | Lapsker | 51/90 |

FOREIGN PATENT DOCUMENTS

| | | |
|---|---|---|
| 46604 | 3/1982 | European Pat. Off. . |
| 67402 | 12/1982 | European Pat. Off. . |

*Primary Examiner*—Robert P. Olszewski

*Attorney, Agent, or Firm*—Sughrue, Mion, Zinn, Macpeak, and Seas

[57] ABSTRACT

There is provided a surface-dressing tool for petrous materials exhibiting a better bite for a lower sound level and a lower energy consumption in that it comprises a pair of cylindrical surface-dressing rollers mounted rigidly on the ends of axles extending parallel between them. The driving force on a pair of rollers on one and the same axle is the resultant of the friction components of opposite sign of each roller in relation to the working surface.

4 Claims, 2 Drawing Sheets

SURFACE-DRESSING ROLLERTOOL

This is a continuation of application Ser. No. 877,814, filed June 24, 1986 now abandoned.

BACKGROUND OF THE INVENTION

The present invention relates to a tool for dressing the surface of a petrous (i.e. rocky or stony) material which presents a plane surface, comprising a backplate mounted to rotate on a spindle perpendicular to the said plane face in a plane parallel to that face and furnished underneath with a plurality of cylindrical abrasive rollers of equal diameters, mounted on bearings to be freely rotatable around their principal axes, in a path which is eccentric with respect to the said driving spindle, the arrangement being such that the rollers exibit simultaneously a rolling component and a component of sliding which is tangential with respect to the material.

This type of tool is particularly adapted to equip either a polishing assembly or an automatic polisher designed for dressing, for smoothing and polishing very hard rocks such as granite with the aim of obtaining on them a surface finish sufficient to receive a gloss.

PRIOR ART

It is currently usual to employ diamond tools for the first dressing operations on stony materials sold in the form of plaques or tiles.

For example European Patent Application No. 0 067 402 describes a dressing tool for hard rock. This tool comprises a vertical spindle and rollers fitted with diamond crowns and mounted to rotate about a horizontal axis such as to dispose the working surface of the crowns in a common horizontal plane. The rollers are preferably distributed at each of the apices of a regular polygon inscribed in a circle of which the centre is determined by the vertical spindle. They are orientated tangentially with respect to a concentric circle of arbitrarily chosen radius. Each roller is thus mounted on its own axis parallel to the surface to be dressed.

The chief known drawbacks of this tool are the lack of bite, the rapid wear of the diamond-bearing crowns and the noise which is generated. It appears that these faults are due to excessively high speed of rotation of the abrasive element.

By modifying the orientation of the rollers one can vary the surface swept out by the generatrix of contact of each roller. This surface is that defined between the circles determined by the ends of each generatrix of contact of the rollers with the stony material.

The working surface is a maximum when the dressing roller is mounted on a radial axle which corresponds to the limit situation of a straight line orientated tangentially with respect to a circle of zero radius. However it has to be faced in this case that the efficiency of the tool is negligible because the action of the roller is reduced essentially to a rolling one in the course of which the peripheral speed of the rollers rotating around their own axes parallel to the face under treatment is a maximum and the relative sliding movement is almost zero.

By contrast the working surface of the roller is reduced to a tiny annular area when the roller is orientated tangentially to a circle of large diameter. The peripheral speed of the roller in itself is then a minimum and the sliding movement of the rollers over the stony material is a maximum.

The efficiency of the tool is improved but it acts on an excessively small working suface.

From European Pat. No. 46604 there is also known a tool for rough dressing, smoothing and polishing solid surfaces. This known tool comprises a horizontal rotary backplate carrying frusto-conical rollers disposed radially with their larger ends directed towards the outer edge of the backplate. These rollers are set in rotation around their own axes by a peripherally toothed crown wheel secured to the frame of the machine. The sense of rotation is chosen to be opposite that of the rotation of the backplate, such that the speed of rotation of the rollers and of the backplate are subtracted at the plane of the generatrix of the contact with the stony material.

The appropriate dimensioning of the diameters of the rollers and the choice of the speed of rotation of the back plate and of the rollers needed in order to obtain uniform distribution of the wear of the diamond segments of the rollers is quite difficult enough. The driving mechanism of the rollers is complicated because it includes numerous moving mechanical parts and therefore is subject to wear.

SUMMARY OF THE INVENTION

The present invention aims to remedy the abovementioned drawback and proposes a dressing head of a simple and rugged construction, exhibiting better bite for a lower sound level and lower energy consumption.

It relates to a tool for dressing mineral materials comprising a backplate mounted to rotate on a spindle perpendicular to the said plane face and to be driven in a plane parallel to that face and provided underneath with a plurality of cylindrical abrasive rollers of equal diameters, mounted on bearings to be freely rotatable about their own axes in a path which is offset with respect to the driving spindle, in such a manner that the rollers exhibit simultaneously a rolling component and a sliding component which is tangential with respect to the material, characterised essentially in that the rollers are mounted in pairs rigidly on the ends of axles parallel to the dressing plane, if necessary being disposed eccentrically with respect to the driving spindle of the tool.

According to one feature of the invention the axles are mounted to rotate in bearings which are arranged between the rollers.

Considering the pairs of rollers mounted on a common axle it will be apparent that one of the rollers of each pair exhibits a relative speed which is lower than that of the second roller with respect to the mineral material.

BRIEF DESCRIPTION OF THE DRAWINGS

Other features and details of the invention will become apparent in the course of the following detailed description of one particular embodiment of the invention, with reference to the accompanying drawings.

In the drawings.

In the drawings, the same reference numerals designate identical or equivalent elements.

DETAILED DESCRIPTION OF THE PREFERRED EMBODIMENT

Figure 1:
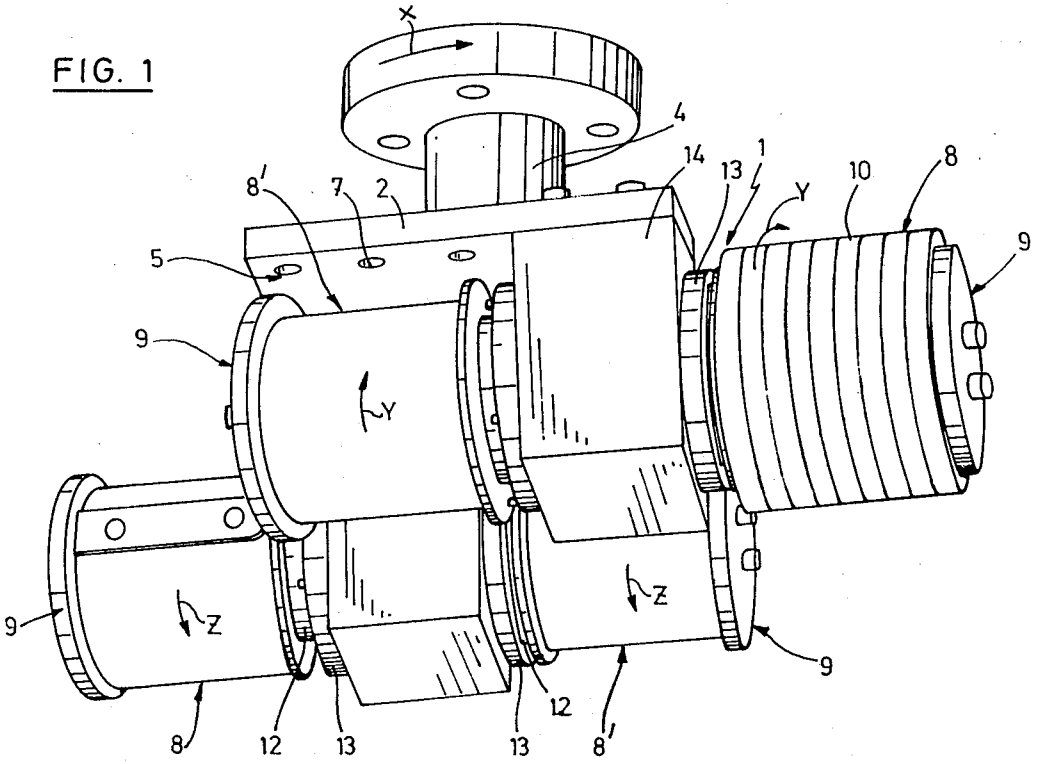
FIG. 1 is a perspective view of a dressing tool with roller heads in accordance with the invention.
Figure 2:
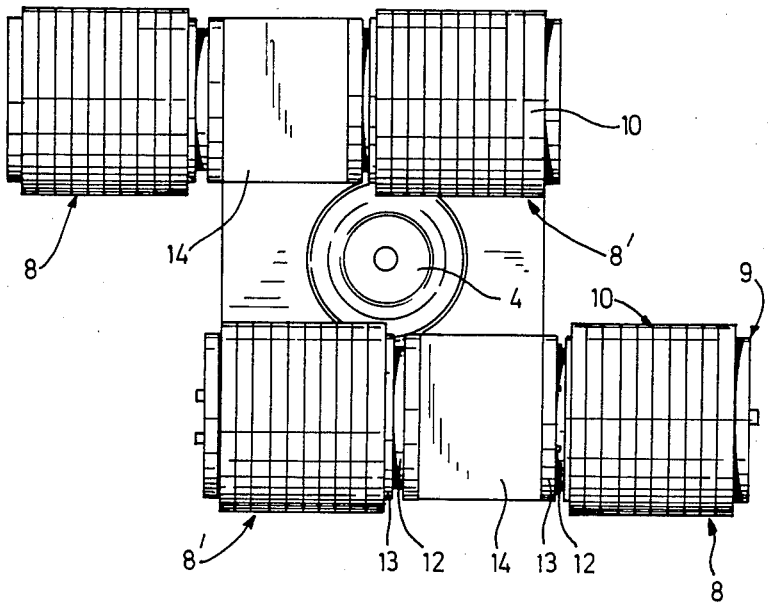
FIG. 2 is a plan view of the tool of FIG. 1 from below.
Figure 3:
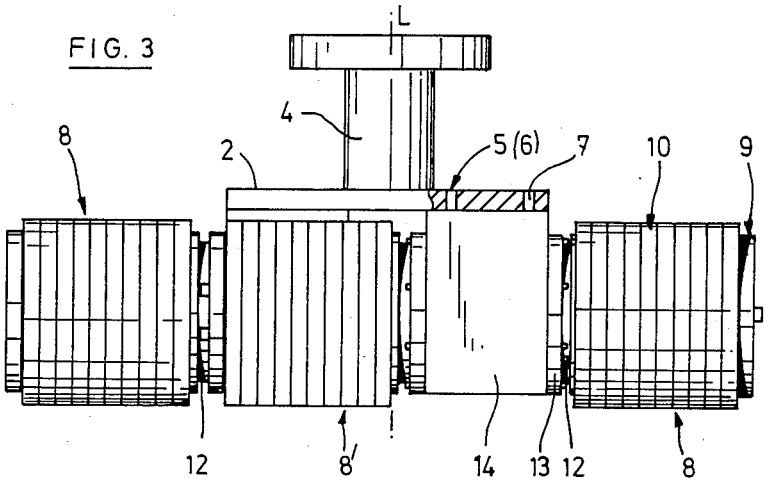
FIG. 3 is a side elevation of the tool.

As illustrated in FIGS. 1 to 3, a surface-dressing tool indicated as a whole by the reference numeral 1 comprises a rotary head constituted by a rectangular horizontal backplate 2 mounted in the centre 3 of a vertical driving spindle 4. The backplate 2 is machined on its lower face and has several rows 5, 6 of attachment holes 7.

The lower face of the backplate 2 is equipped with rollers 8, 8'.

Each roller 8 or 8' is made up of a cylindrical body 9 of around 10 to 200 mm radius, on which is mounted a series of crowns 10 formed of diamond-bearing cylindrical rings side by side.

The rollers 8, 8' are advantageously equipped with an abrasive coating obtained in the form of one or more rings 10 threaded onto a cylindrical body 9.

The rollers are coupled together rigidly in pairs 8, 8' on the ends of axles 12, carried by robust bearings 13, mounted in pedestals 14.

The pairs of rollers 8, 8' are mounted parallel to one another symmetrically with respect to the axis of rotation of the vertical spindle 4. They are disposed eccentrically with respect to the axis of rotation of the spindle 4 such as to generate for each of the roller 8, 8' of a given pair curved trajectories of different radii of curvature.

By virtue of the rotary movement of the backplate 2 around its vertical axis 4 regardless of what is the speed of linear displacement of the material, not shown, in a plane perpendicular to this axis one of the rollers 8 exhibits a speed relative to the mineral material which is greater than that of the other roller 8'.

The result is a driving force on a pair of rollers 8, 8' on the same axle 12 of which the magnitude is equal to the difference between the opposing unequal forces generated by friction components of opposite sign of each roller with respect to the working surface.

This driving force results in an angular speed Y or Z respectively for each of the pairs of rollers.

It will be observed that the rollers 8, 8' on one and the same axle operate in a different manner.

The roller 8 of greater eccentricity operates downstream whereas the other roller 8' operates in an upstream direction.

It will equally well be observed that in the embodiment illustrated in FIGS. 1 to 3 the angular speeds Y and Z are of opposite sign.

The speed of rotation of the spindle 4 and the size of the backplate and of the rollers as well as the eccentricity determine the relative sliding speeds of the rollers with respect to the mineral material.

A standard central watering arrangement, not shown, extending along the driving spindle 4 of the surface-dressing tool, provides cooling and washing water which reaches each of the rollers 8, 8'.

In one particular embodiment illustrated in FIGS. 1 to 3 each of the rollers 8 has a diameter of 174 mm and a useful length of 120 mm.

The machine disclosed is one of practical and simple construction. The speed of rotation of the rollers around horizontal axes is low and thus generates little noise. The sound level generated by the machine does not exceed 85 $Db_A$. Thus we have here a machine which is less noisy than the known surface-dressing machines.

When, as illustrated in FIG. 1, the driving spindle turns in the direction X each pair of tools 8, 8' turns in the direction Y, Z induced by the roller 8 of greater eccentricity.

In the particular embodiment illustrated in FIGS. 1 to 3, the opposing forces in the rollers of a given pair are out of balance by reason of the eccentricity of the said pair. The principal direction of rotation is that of the roller which is furthest from the centre.

The same result could be obtained or indeed accentuated by envisaging rollers of different lengths. Thus a pair of rollers coupled together rigidly and mounted symmetrically with respect to the spindle 4 would be driven by the larger roller.

The abrasive coating on a roller 8, 8' could be constituted by a single sleeve 10 mounted on a cylindrical body 9.

What is claimed is:

1. A surface-dressing tool for hard mineral material presenting a plane face to be treated, said tool comprising a rotary backplate mounted parallel to said face and arranged to be driven in rotation on a spindle perpendicular to said face, said backplate carrying at least one pair of cylindrical abrasive rollers, said rollers of each pair being fixedly mounted to the opposite ends of a common axle joining them, said axle mounted to said backplate, said rollers being mounted to rotate around their own axes in contact with the material and in such a manner that said rollers of said pair exhibit simultaneously the same rolling component and oppositely directed sliding components coinciding with a generatrix of said cylindrical abrasive rollers.

2. The tool set forth in claim 1, wherein said axle is carried rotatably on a pedestal disposed between said rollers.

3. The tool set forth in claim 1 wherein, both rollers of said pair have, at their contact points with the material, speeds relative to the material which are oriented in the same direction and sense as the translation velocity of the centers of rotation of said pair of rollers, and the speed magnitude of one of the rollers of said pair relative to the material is lower than that of the other roller of said pair.

4. The tool set forth in claim 1, wherein all of said rollers have the same diameter and have diamond segments which have the same diameter and which attack the material.

* * * * *